US009270018B2

(12) United States Patent
Mierke et al.

(10) Patent No.: US 9,270,018 B2
(45) Date of Patent: Feb. 23, 2016

(54) ROOFTOP ANTENNA, IN PARTICULAR MOTOR VEHICLE ROOFTOP ANTENNA WITH ASSOCIATED PLUG-TYPE CONNECTION DEVICE

(75) Inventors: Frank Mierke, München (DE); Gerhard Stadler, Raubling (DE); Florian Butscher, Aschau/Chiemgau (DE); Gerhard Vogt, Rosenheim (DE); Johann Frisch, Ruhpolding (DE)

(73) Assignee: KATHREIN-WERKE KG, Rosenheim (DE)

( * ) Notice: Subject to any disclaimer, the term of this patent is extended or adjusted under 35 U.S.C. 154(b) by 346 days.

(21) Appl. No.: 14/110,284

(22) PCT Filed: Mar. 15, 2012

(86) PCT No.: PCT/EP2012/001164

§ 371 (c)(1), (2), (4) Date: Oct. 7, 2013

(87) PCT Pub. No.: WO2012/136306

PCT Pub. Date: Oct. 11, 2012

(65) Prior Publication Data

US 2014/0028507 A1 Jan. 30, 2014

(30) Foreign Application Priority Data

Apr. 7, 2011 (DE) ..... 10 2011 016 294

(51) Int. Cl.
*H01Q 1/32* (2006.01)
*H01Q 1/12* (2006.01)
(Continued)

(52) U.S. Cl.
CPC ..... *H01Q 1/3275* (2013.01); *H01Q 1/1214* (2013.01); *H01R 24/50* (2013.01); *H01R 2103/00* (2013.01); *H01R 2201/02* (2013.01); *H01R 2201/26* (2013.01)

(58) Field of Classification Search
CPC . H01Q 1/1271; H01Q 1/3275; H01Q 1/1278; H01R 2201/02
USPC ..... 343/713, 872, 711; 439/63
See application file for complete search history.

(56) References Cited

U.S. PATENT DOCUMENTS

| | | | | |
|---|---|---|---|---|
| 7,652,630 | B2 | 1/2010 | Rosenberger et al. | |
| 2009/0040121 | A1 * | 2/2009 | Rosenberger | H01Q 1/1214 343/713 |
| 2010/0231467 | A1 * | 9/2010 | Schnuerer | H01Q 1/3275 343/713 |

FOREIGN PATENT DOCUMENTS

| | | | |
|---|---|---|---|
| BQ | 295 00 961 | U1 | 6/1995 |
| CN | 101133515 | B | 4/2011 |

(Continued)

OTHER PUBLICATIONS

Notification of the First Office Action and Search Report dated Dec. 12, 2014, issued in corresponding Chinese Patent Application No. 201280009623.4.

(Continued)

*Primary Examiner* — Dameon E Levi
*Assistant Examiner* — Collin Dawkins
(74) *Attorney, Agent, or Firm* — Nixon & Vanderhye P.C.

(57) ABSTRACT

An improved rooftop antenna is characterized, inter alia, by the following features: the base (7) has a protruding base foot part (17) on the base lower side (7*e*) of said base; the base foot part (17) is formed integrally with the remaining part of the base (7) or connected thereto and is electrically conductive or coated, together with the base (7), with an electrically conductive layer; the base foot part (17) has a channel (117), which passes through the foot part (17) transversely and preferably perpendicular to the base (7) in a plug-in and joining direction (Z) for accommodating the at least one coaxial line (21); and the coaxial line (21) is inserted into the at least one channel (117) of the base foot part (17) in such a way that at least one section of the outer circumference of the outer conductor (27) of the coaxial line (21) is pressed mechanically with the electrically conductive inner wall of the channel (117) of the base foot part (17) and DC contact is thereby made therewith.

23 Claims, 11 Drawing Sheets

(51) Int. Cl.
*H01R 24/50* (2011.01)
*H01R 103/00* (2006.01)

(56) References Cited

FOREIGN PATENT DOCUMENTS

| | | | |
|---|---|---|---|
| DE | 20 32 619 | A | 1/1972 |
| DE | 43 36 191 | A1 | 5/1995 |
| DE | 695 09 431 | | 1/2000 |
| DE | 20 2004 015503 | U1 | 12/2004 |
| DE | 20 2005 004 658 | U1 | 6/2005 |
| DE | 10 2005 044 610 | | 3/2006 |
| DE | 10 2005 044 611 | A1 | 3/2006 |
| DE | 20 2005 020 107 | U1 | 2/2007 |
| DE | 10 2006 025 176 | A1 | 12/2007 |
| DE | 10 2007 050 109 | A1 | 4/2009 |
| DE | 10 2009 051 605 | A1 | 5/2011 |
| EP | 1 286 414 | A1 | 2/2003 |
| EP | 1 801 932 | A1 | 6/2007 |
| EP | 1 863 119 | B1 | 12/2007 |
| EP | 1 903 632 | B1 | 3/2008 |
| EP | 1 801 932 | B1 | 4/2008 |
| EP | 1 928 054 | A1 | 6/2008 |
| WO | WO 2006/087225 | A1 | 8/2006 |
| WO | WO 2006/108589 | A1 | 10/2006 |
| WO | WO 2006/108608 | A1 | 10/2006 |
| WO | WO 2006/108624 | A1 | 10/2006 |

OTHER PUBLICATIONS

English translation of the International Preliminary Report on Patentability mailed Oct. 10, 2013, issued in corresponding International Application No. PCT/EP2012/001164.
International Search Report for PCT/EP2012/001164 mailed Jul. 16, 2012.
Written Opinion of the International Searching Authority mailed Jul. 16, 2012.

* cited by examiner

ROOFTOP ANTENNA, IN PARTICULAR MOTOR VEHICLE ROOFTOP ANTENNA WITH ASSOCIATED PLUG-TYPE CONNECTION DEVICE

The invention relates to a rooftop antenna, in particular a motor vehicle rooftop antenna comprising an associated plug-type connection device in accordance with the preamble of claim 1.

Nowadays, in particular in the field of motor vehicles, motor vehicle rooftop antennae are often used which are adapted for example for operation in a mobile communications field on the one hand and for receiving radio programmes on the other hand. Furthermore, receiving systems for determining the position of the vehicle are generally also accommodated in these motor vehicle rooftop antennae, and in accordance with the current standard consist of what are known as GPS receivers.

Motor vehicle antennae of this type are conventionally accommodated in an antenna housing, which can be mounted on the motor vehicle and comprises an antenna hood which is mounted on a corresponding pedestal. On the pedestal, generally parallel thereto, a printed circuit board is accommodated on which the individual antenna elements are subsequently positioned and electrically connected.

The motor vehicle antenna can generally be mounted and anchored at a suitable point by way of adapted holding elements which can be installed mechanically from below, that is to say from the interior of the vehicle. In this context, it is further conventional to pass a corresponding cable loop through a provided opening and to connect it in the region of the printed circuit board. In this context, at least one cable, preferably a coaxial cable, is generally provided for each antenna.

So as to reduce the complexity of mounting and anchoring, motor vehicle rooftop antennae have also been disclosed in which the antenna housing is equipped with a corresponding number of coaxial plug-type connectors, it being possible to connect a corresponding number of further plug-type connectors, which are provided on the end of a cable loop, on the interface which is formed in this manner.

To this extent, corresponding rooftop antennae having a comparable construction have also been disclosed for example in DE 43 36 191 A1, DE 295 00 961 U1, DE 2 032 619 and also DE 10 2004 046 979.

An antenna comprising an associated fastening means is also known from WO 2006/087225 A1. A chassis of the motor vehicle rooftop antenna comprises a fastening part which is introduced into the interior of the motor vehicle through an opening in the motor vehicle roof and is biased for example by means of a biasing means.

In this context, for passing through the roof, a plurality of HF plug-type connections are provided, which consist of at least one plug rigidly arranged on the foot part. A coupler which is attached to a cable loop can be plugged onto these.

However, the construction of the arrangement as a whole is relatively tall, and this is often a problem since in particular the construction space located below the motor vehicle roof generally only turns out very low.

A highly integrated multi-band fin antenna for a motor vehicle, which comprises a printed circuit board parallel above a pedestal part, is known from the subsequently published document DE 10 2009 051 605 A1.

In each case, plug-type contacts, onto which plug-type connectors can be plugged from the interior of the motor vehicle, that is to say from below, are provided on the printed circuit board, centrally on the leading side and positioned offset towards the side regions on the trailing side.

Three further separate wire lines, which are fixed to the printed circuit board, project perpendicularly away therefrom and lead to a rectangular plug housing, are provided on the trailing side between two of the adjacently arranged plug-type connectors.

A vehicle and a method for manufacturing a vehicle antenna are also known from DE 10 2007 050 109 A1. The antenna comprises a pedestal and a printed circuit board which is provided on the upper side of the pedestal, at least one coaxial line of which the external conductor is preferably connected to the pedestal part in a material fit and has shared electric conductivity, projecting downwards from the pedestal. An internal conductor, separated by a dielectric, is guided in this coaxial external conductor. In an alternative embodiment, the external conductor, which per se is preferably connected to the pedestal part in a material fit, can only initially be connected to the external conductor in a manner conditional on the manufacture, and be mechanically separated therefrom and thus insulated after production is complete.

The internal conductor is connected to the printed circuit board located above the pedestal, just like the external conductor, which is galvanically connected to the printed circuit board by means of a spring contact.

The at least one downwardly projecting aforementioned coaxial external conductor is ultimately protected and encased by a plug housing, which can be provided around the external conductor in a further production step by spraying. It is also possible for the plug housing to be manufactured separately and to be placed on the external conductor.

A generic rooftop antenna for a vehicle is known from WO 2006/108624 A1, which describes an antenna comprising a pedestal and a printed circuit board located on the pedestal, on which printed circuit board one or more antennae are provided. One or more coaxial conductors can be led away on the underside of the printed circuit board. The external conductor of the coaxial conductors comprises an external-conductor cylinder, which is preferably electrically connected and mechanically anchored on the printed-circuit-board side, preferably to the underside of the printed circuit board. By contrast, the internal conductor of the coaxial conductors is electrically conductively connected to the printed circuit board, the pedestal consisting of an electrically conductive material or being coated with an electrically conductive material.

A plug arrangement for an HF signal path is additionally known from DE 20 2004 015 503 U1. This prior publication describes and discloses a component comprising a pedestal or a pedestal-like plate construction, which is penetrated by one or more coaxial conductors. In this context, in each case the external conductor is rigid and preferably connected to the wall of the component in a material fit.

As a result of this material-fit connection between the pedestal and the external conductor, a passage is created for an internal conductor, which extends inside the external conductor and in accordance with this prior publication is split in two, the two parts being interconnected via a flat spiral spring. Aside from the external conductor which is rigidly connected to the pedestal, no further additional pedestal part is provided.

A comparatively improved motor vehicle antenna comprising an associated HF plug-type connection device is also known from EP 1 801 932 B1 or DE 20 2005 020 107 U1.

In accordance with this generic prior publication, the plug-type connector unit is connected to the printed circuit board in a mechanically favourable manner in that at least some coaxial plug-type connectors are provided with projections extending in the plugging direction or with a corresponding electrically conductive accessory comprising corresponding projections, these projections projecting for example into holes in the printed circuit board. These holes may preferably also be through-connected. The ends of these projections are electrically soldered to the printed circuit board, that is to say generally to the large-area potential plane or earth plane which is formed there, resulting in shielding being achieved. Thus, not only an electrical earth connection is ensured, but also a rigid mechanical connection between the plug-type connector unit and the integrated coaxial plug-type connectors with the printed circuit board.

Since the HF internal conductors no longer project as far as the upper side of the printed circuit board through holes which are formed in the printed circuit board, or project beyond this upper side of the printed circuit board, but instead are reflow-soldered bluntly to the underside of the printed circuit board, in accordance with this embodiment it is even possible for example to position a standard ceramic patch antenna above the plug-type connector unit, that is to say in a region in which the ends of the internal conductor of the plug-type connector would come to be positioned and soldered on the opposite side of the printed circuit board.

In addition, it should also further be noted that in accordance with DE 20 2005 004 658 U1 it has also already been proposed for a corresponding number of what are known as first coaxial plug-type connectors to be fixed in what is known as a plug interface on the antenna housing, and for second coaxial plug-type connectors further to be provided, which are held on a further plug-type connector part in such a way that the two plug-type connectors can be plugged into one another so as to produce an electric connection of all of the coaxial lines.

Since the naturally expected tolerance problems occur, and plugging together two or more coaxial plug-type connectors would always lead to problems in this case, it has been proposed in accordance with DE 20 2005 004 658 U1 to install and position plug-type connectors, which are held and positioned on what is known as the plug interface, in a resiliently springy manner, specifically with the assistance of resilient spring elements. These are arranged and formed in such a way that the second coaxial plug-type connectors can be pre-positioned at the respective predetermined position, aside from deviations due to tolerances, and can be deflected from this point in a resiliently springy manner in the plane perpendicular to the plugging direction.

In this context, DE 20 2004 004 658 U1 further describes that a plug-type connector, the interfaces of which extend transverse to the installation direction of the motor vehicle antenna and thus generally parallel to the motor vehicle roof, is provided within the interior of the vehicle. In this context, the coaxial plug-type connectors comprise signal conductor elements in the form of strip lines, which proceed from the cable terminals extending parallel to the roof and which lead to further coaxial plug connectors, arranged perpendicular thereto, via which a coaxial plug connection to the antennae provided on the motor vehicle roof can be produced.

Finally, reference should also be made to EP 1 903 632 B1, EP 1 863 119 B1 and DE 10 2006 025 176 A1. From these prior publications, antenna constructions are known which comprise an antenna means outside the sheet metal of the vehicle body and a further component inside the sheet metal of the vehicle body, optionally also in the form of a second antenna means.

By contrast, the object of the present invention is to provide a further improved rooftop antenna, in particular a motor vehicle rooftop antenna, which is of a high mechanical stability on the one hand and has good electrical attachment and connection options on the other hand, and which at the same time, as far as possible, only requires a small or extremely small installation space below a roof, in particular a motor vehicle roof. This object is achieved according to the invention by way of the features specified in claim 1. Advantageous embodiments of the invention are specified in the dependent claims.

In the context of the invention, as a result of the configuration primarily of the HF plug connection, a highly favourable connection can be provided between a rooftop antenna and an internal unit, optionally comprising a further printed circuit board, which is provided under the roof. In this context, the external unit can be implemented as an antenna comprising coaxial and HF lines proceeding therefrom (which unlike in the prior art no longer have to be laid separately) whilst the required mounting hole and the joining space below the vehicle outer shell are simultaneously minimised. As an auxiliary function of this direct plugging, very long (and thus expensive) coaxial lines to the other internal units in the motor vehicle, which are configured as stand-alone solutions and are generally installed anywhere in the vehicle, are no longer required.

In this context, it may also be emphasised that in the context of the invention optimised HF properties can be implemented as regards the provided coaxial lines, specifically in such a way that incorrect couplings are reliably prevented even when particular tolerance errors occur.

Above all, as stated above, the solution according to the invention has the further advantage that electronic internal units (which for example serve to process the electric signals or the HF signals) no longer have to be accommodated remotely from the antenna in the motor vehicle (with the result that correspondingly long lines are thus required), but these electric and electronic components can instead be positioned and connected under the vehicle outer skin, directly in the region of the foot part, which penetrates the roof opening, of a motor vehicle rooftop antenna.

The vertical part of the HF plug-type connection unit according to the invention, which part is electrically connected and mechanically rigidly connected to a printed circuit board (the printed circuit board usually being provided on a chassis on the side of the antenna chassis opposite the motor vehicle roof), comprises coaxial lines, which in a known manner comprise an internal conductor, a dielectric surrounding the internal conductor, and an external conductor, the external conductor preferably being soldered to the printed circuit board via foot points in the form of small pins, resulting in the mechanical connection also being implemented.

In the context of the invention, improved mechanical fastening and electric shielding are achieved in that the chassis of the antenna means is used as shielding for the external conductor. For this purpose, part of the chassis is extended downwards through the motor vehicle mounting hole, and thus serves simultaneously as a support and fastening means for the plug sockets. In this context, the plug sockets consist of the aforementioned external conductor, the internal conductor and the dielectric, these plug sockets being pressed into corresponding (vertical) ducts in the chassis which extend in the plugging or joining direction, in such a way that these external conductors are thus mechanically rigidly anchored and held, and the extended portion of the chassis thus serves as shielding and/or as an external conductor by way of the galvanic contact.

In a particularly preferred development of the invention, it is also possible for an interface to be provided at the lower end of the coaxial lines in each case, so as to provide a 90° transition to the plug-type connectors at this point, via which for example a motor vehicle internal unit can be attached by way of a plugging movement more or less parallel to the motor vehicle outer skin (that is to say generally the motor vehicle roof). In this case too, the foot part of the chassis, which part extends through the mounting opening in the motor vehicle roof, forms the above-disclosed shielding.

In this context, during the joining step, it is possible in the context of the invention for the external conductor proceeding from the printed circuit board to be pressed—as stated—into the foot part of the chassis, that is to say into correspondingly vertically extending ducts in the foot part of the chassis, so as to produce a galvanic connection to the chassis. The contact of the internal conductor to the following internal conductor portions (which extend radially and thus preferably perpendicularly with respect to the first internal conductor portions, specifically more or less parallel to the outer skin, provided with the mounting opening, of the motor vehicle) is produced in that the leading tip of the respective internal conductor is pressed into a slotted (perforated) part, leading in the joining direction, of the following internal conductor, which as stated is preferably orientated perpendicular to the first internal conductor portion. In this context, air is provided as the dielectric in the connection region between the two internal conductors, which are generally orientated mutually perpendicular.

Similarly, by way of a plurality of pins which extend mutually parallel and have an elbow at the bottom, a data bus can be produced, that is to say a connection for example in the form of a plurality of data lines of which the pins are likewise orientated horizontally, that is to say perpendicular to the vertical portion which leads to the printed circuit board of the motor vehicle antenna.

In an elbowed end of this type, extending through 90°, of the coaxial line and of the data bus, it is subsequently possible without difficulty to connect a shallow housing, in which further electronic assemblies which process the HF signals are accommodated, through a horizontal plugging path, for example directly on the inside of the motor vehicle outer skin.

The invention thus relates to a rooftop antenna comprising an electric or high frequency contact option, in particular comprising a motor vehicle internal unit for processing the electric signals and the high-frequency signals. This connection should preferably be possible via direct plugging, while taking into account the prevailing construction space conditions. In the context of the invention, this should be possible even with a minimal mounting opening in the vehicle outer skin, specifically even if only a minimum possible construction space is available between the vehicle outer skin and a corresponding vehicle ceiling.

In this context, in a preferred embodiment, a 90° line transition is provided, which makes it possible for corresponding cables and preferably the aforementioned internal unit which provides further data and high frequency processing to be connected via a joining path to the terminals for the motor vehicle antenna, which preferably extends perpendicular to the mounting direction in which a downwardly projecting foot part of the motor vehicle antenna is introduced into the mounting opening of a motor vehicle outer skin.

Finally, in the context of the invention, it is possible to combine the individual plugs with a plug block, which serves to minimise the tolerances of the individual components.

In the following, the invention is explained in greater detail by way of drawings, in which, in detail:

Figure 10A:
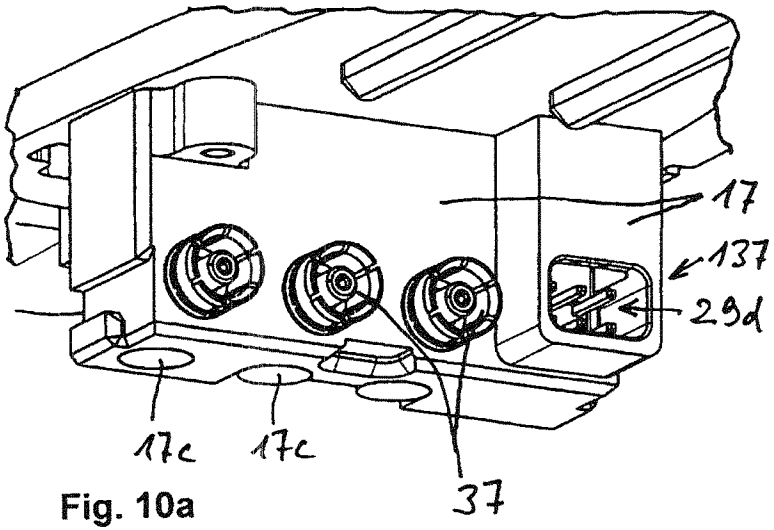
Figure 10B:
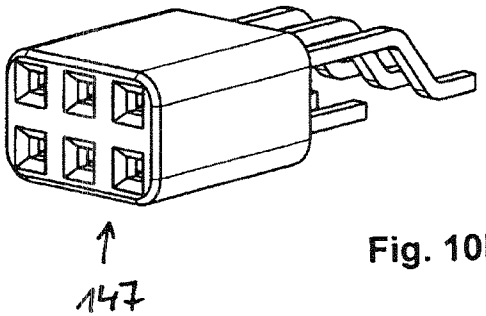
Figure 11B:
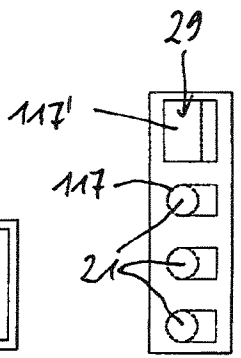
Figure 11A:
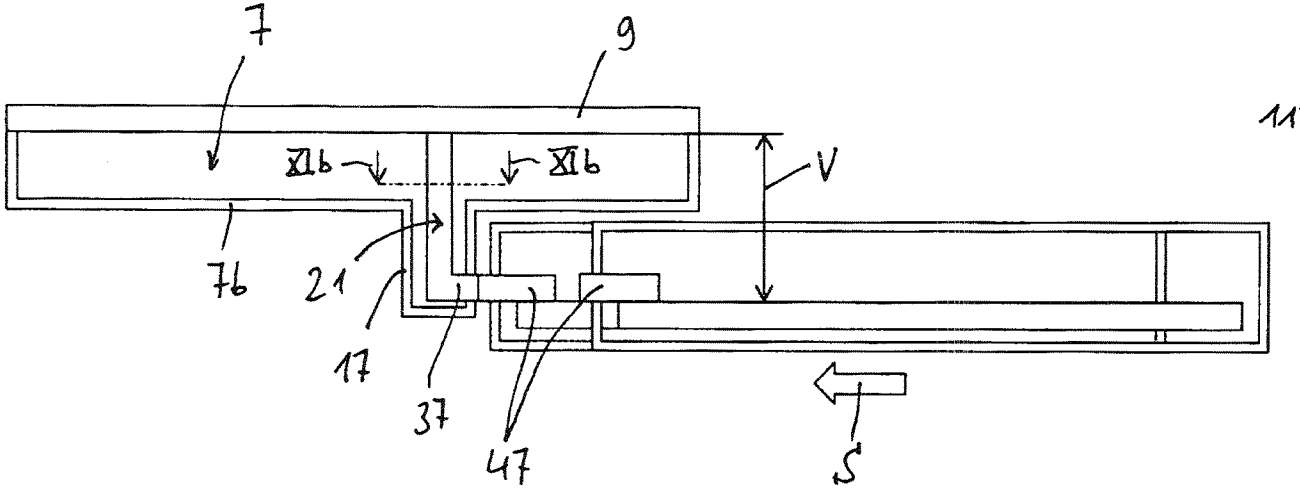

FIG. 10*a* is a partially perspective view of a plug housing for the data connection, which is integrated into a chassis;

FIG. 10*b* is a schematic drawing of a corresponding socket plug for coupling to the plug housing of the data connection;

FIG. 11*a* is a schematic drawing of the construction according to the invention comprising an antenna means and a motor vehicle internal unit in a schematic cross-sectional drawing;

FIG. 11*b* is a cross-sectional view along the line XIb-XIb in FIG. 11*a;*

Figure 12B:
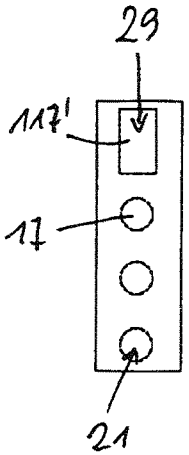
Figure 12A:
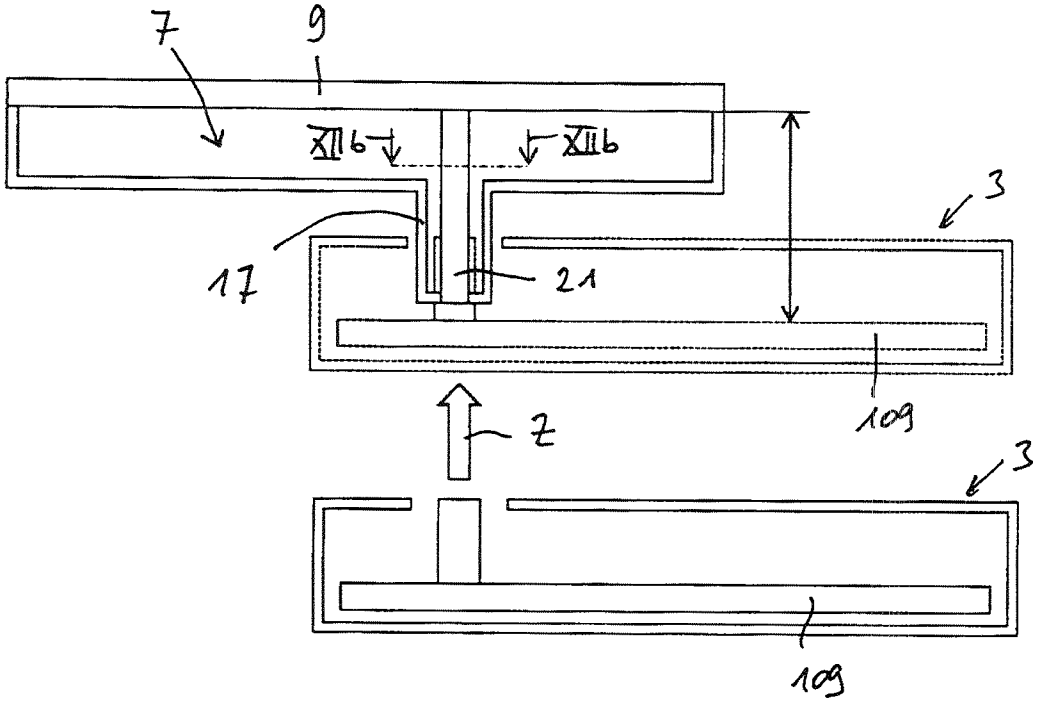

FIG. 12*a* is a drawing modified from FIG. 11*a*, relating to an embodiment slightly modified with respect thereto; and FIG. 12*b* is a cross-sectional view along the line XIIb-XIIb in FIG. 11*a*.

Figure 1:
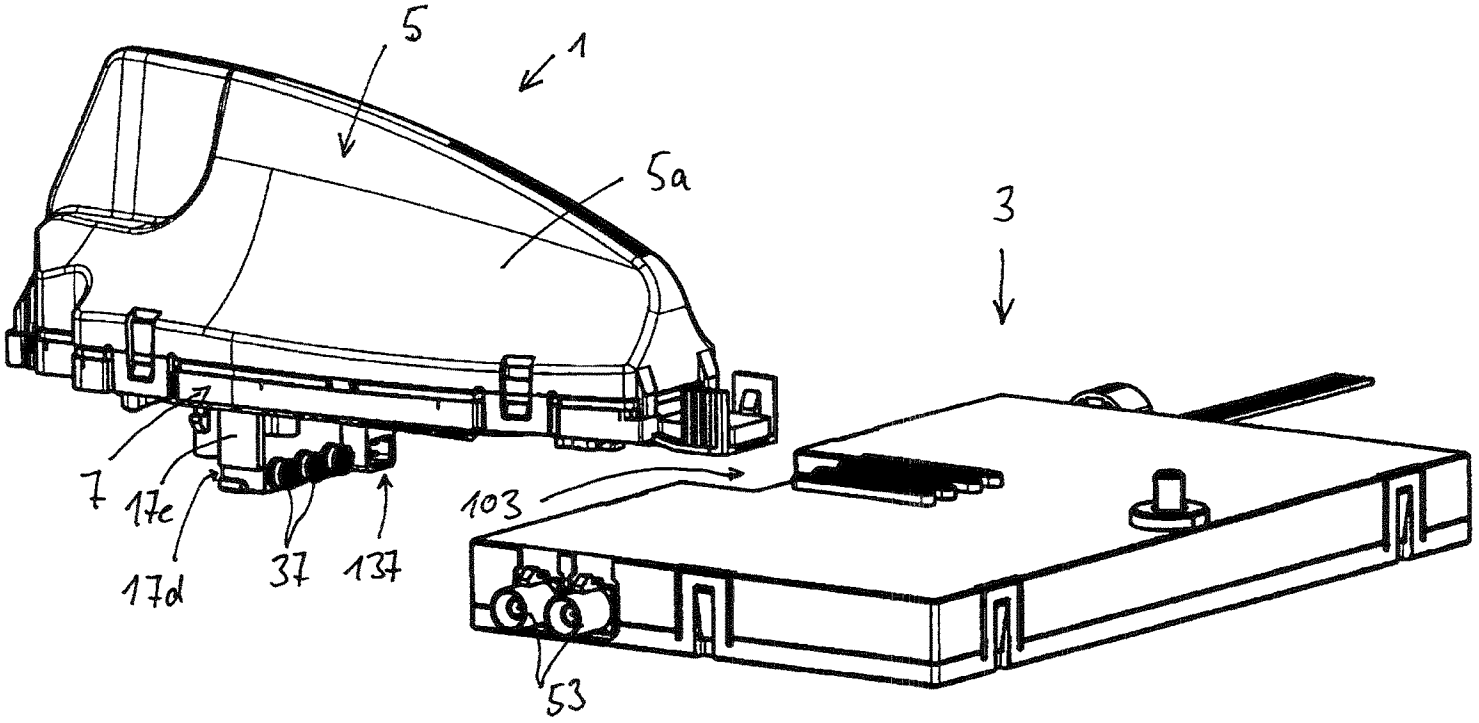
FIG. 1 is a schematic perspective drawing of a rooftop antenna and an internal unit which can be connected thereto.

FIG. 1 is a schematic perspective drawing of an antenna 1, that is to say in particular a rooftop or motor vehicle antenna 1, which ultimately, when mounted in accordance with a first embodiment of the invention, is in electrical contact with an electronic component 3 directly in the region of a through-opening provided in the roof.

The antenna 1 usually comprises an antenna housing 5, which in the embodiment shown comprises an antenna hood 5*a* which is permeable to electromagnetic waves.

The antenna hood 5*a* is generally mounted on, or rigidly connected to, a pedestal or chassis 7, the chassis 7 consisting of or comprising metal or another conductive material in the embodiment shown. In the embodiment shown, the pedestal or chassis 7 preferably consists of a cast metal part. A milled part or conductive injection-moulded plastics material part is also possible.

Figure 2:
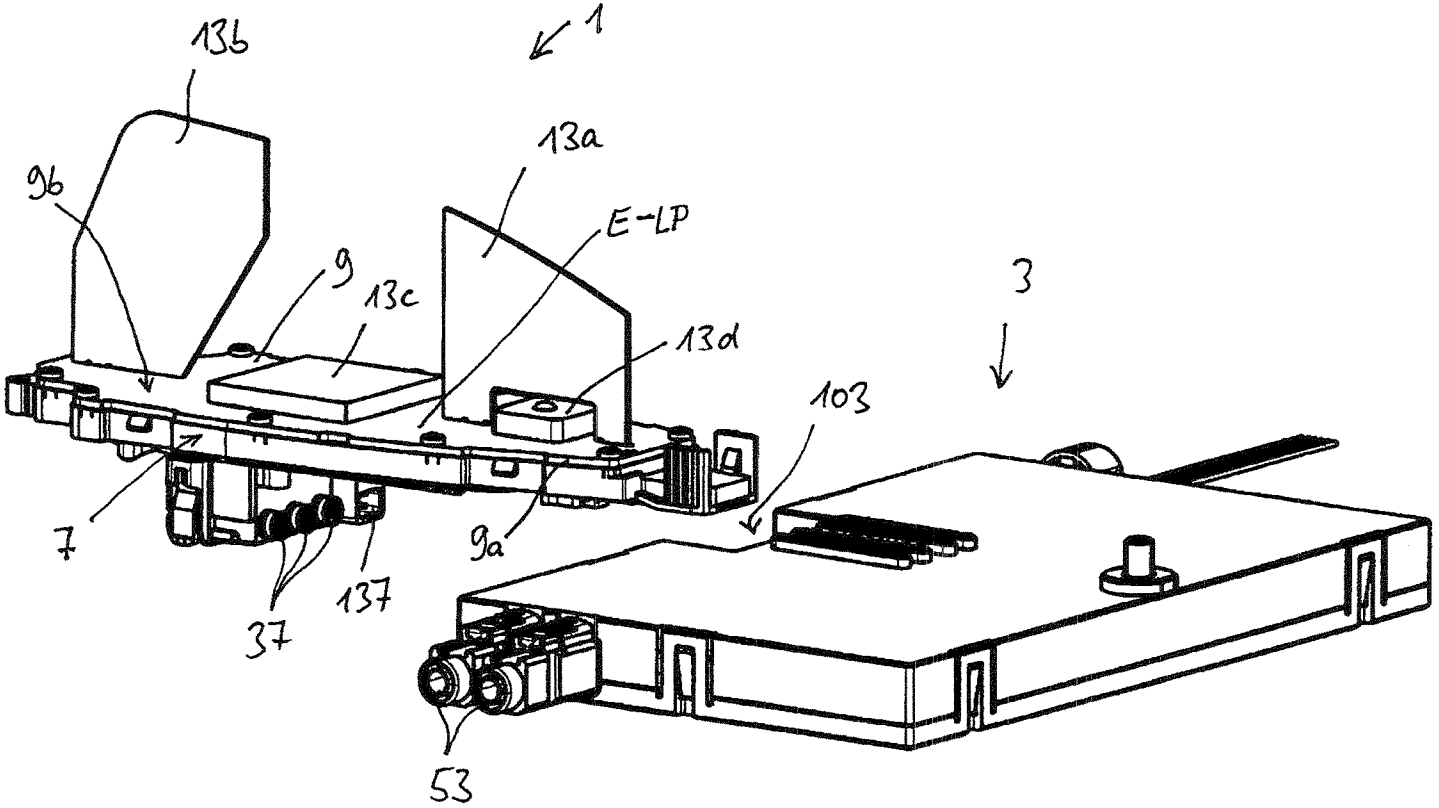
FIG. 2 is a drawing corresponding to FIG. 1, in which some of the components are omitted, in particular the housing cover of the antenna means.

FIG. 2 is a perspective drawing similar to FIG. 1 of an electronic component 3 which has been mounted, attached under the motor vehicle roof on the inside of the vehicle, the antenna hood 5*a*, visible in FIG. 1, of the antenna housing 5 having been omitted in the drawing of FIG. 2.

Figure 3:
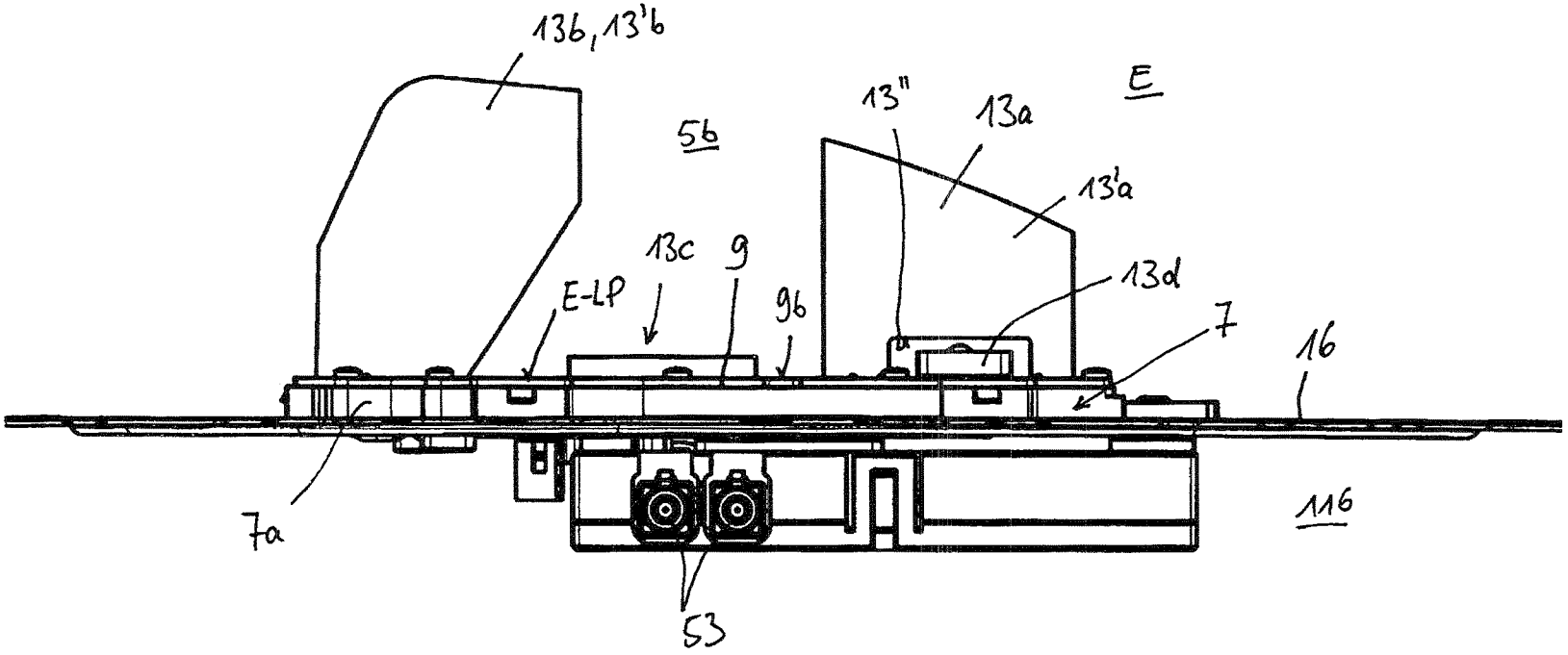
FIG. 3 is a schematic side view of an antenna unit which is connected to a motor vehicle internal unit (omitting the antenna hood)

In this context, FIG. 3 is a transverse drawing of the antenna and the electronic component or internal unit 3 connected thereto, that is to say a perpendicular view of a plane E, which usually extends vertically when the antenna is mounted (the two printed circuit boards or antennae 13*a*, 13*b* being able to lie in this plane or being orientated parallel thereto) and which corresponds to the vertical central plane of the antenna housing 5, which is generally orientated perpendicular to the plane E-LP of the printed circuit board 9.

It can thus be seen that a printed circuit board 9 is arranged parallel to the pedestal or chassis 7 on the upper side 7*a* formed thereby of the pedestal or chassis 7, and in a plan view has an external contour 9*a* (see also FIG. 4) which is usually provided with a smaller transverse and longitudinal extent than the respective transverse and longitudinal extent of the pedestal chassis 7, in such a way that when mounted the housing hood 5*a* which is fastened to the pedestal 7 fully encloses the printed circuit board 9 and receives it in what is known as the antenna housing interior 5*b*.

One or more antenna means for different services may be provided on the aforementioned upper side 9*b* of the printed circuit board 9.

In the present case, a first antenna or antenna arrangement 13*a*, for example in the form of a further printed circuit board 13'*a* positioned perpendicular to the printed circuit board 9, is provided on the metal-coated faces so as to form a first antenna, which for example provides reception and transmission in the context of mobile communications.

In addition, a second antenna 13*b* may be provided, which is likewise arranged for example perpendicular to the printed circuit board 9, and in this context may likewise in turn consist of a further printed circuit board 13'*b*—which by contrast with the first antenna 13*a* is instead positioned in a rear region, that is to say usually trailing in the direction of travel, with respect to the antenna 13*a* which is upstream, that is to say leading, in the direction of travel the antenna formed thereon potentially being suitable for providing other services.

Furthermore, a third antenna 13*c* is provided between the first and second antennae 13*a* and 13*b*, and serves for example for receiving satellite programmes which are broadcast via satellite, that is to say in particular for receiving radio programmes which are broadcast via satellite.

In the embodiment shown, a fourth antenna 13*d* is also provided, namely a GPS antenna 13*d*, which in the embodiment shown is of an approximately square external shape in a plan view, and is positioned on and connected to the printed circuit board 9 which extends parallel to the pedestal 7, below a recess 13" in the region of the first printed circuit board 13'*a* of the first antenna 13*a*.

Since the pedestal of the chassis 7 usually comprises a peripheral pedestal rim 7*c* which is raised above a particular height on the upper side 7*a* of the pedestal with respect to the base or floor 7*b* of the pedestal, electric and electronic components can be accommodated between the pedestal floor 7*b* and the underside 9*c* of the printed circuit board 9 (see FIG. 4) in the component space 12 formed thereby and be electrically connected to the conductive paths which extend on the printed circuit board there.

Figure 4:
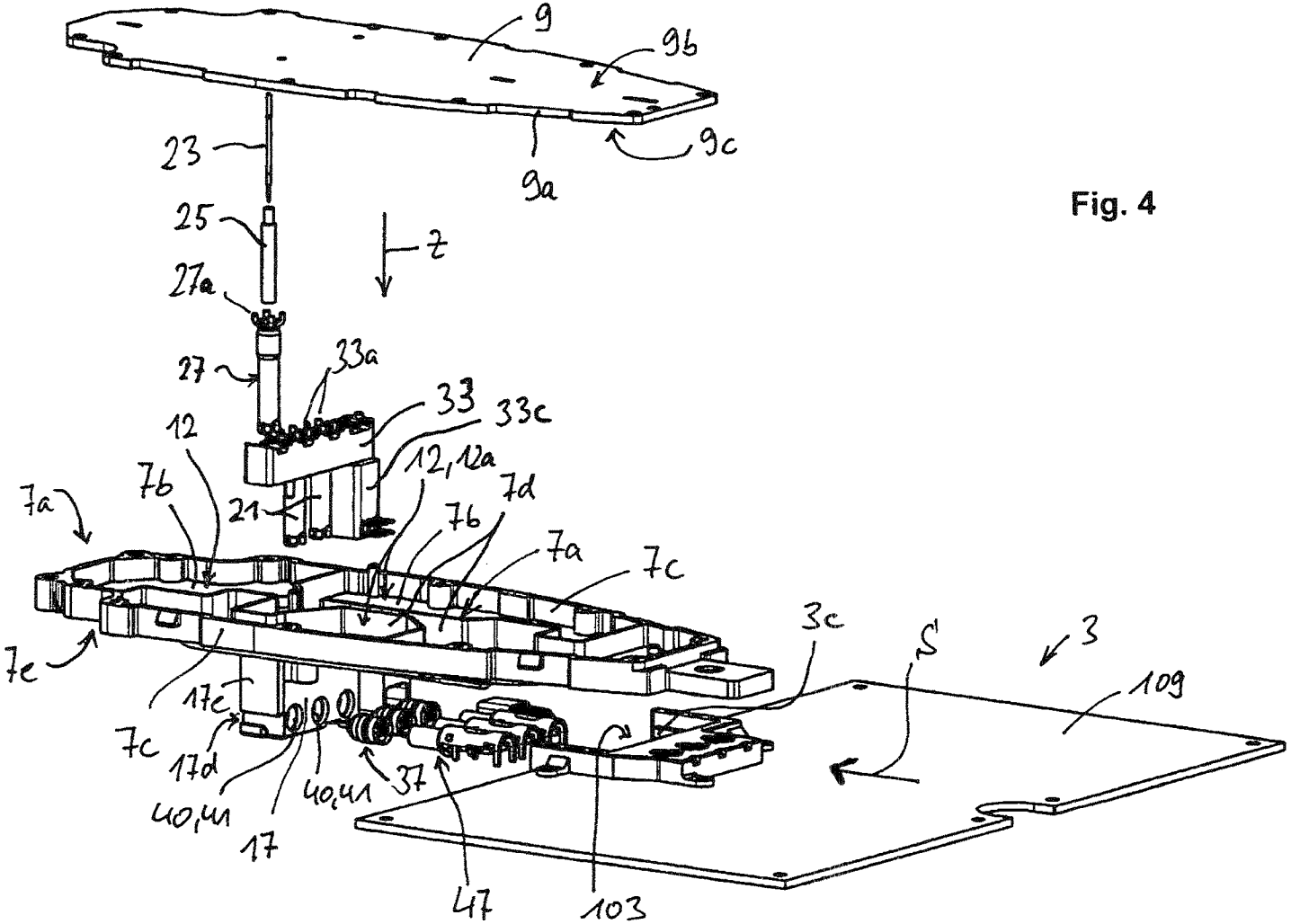
FIG. 4 is an exploded view of the main parts of the antenna unit and the motor vehicle internal components to be connected thereto or the motor vehicle internal module.

FIG. 4 is an exploded view of major parts of the antenna arrangement and the electronic components 3 which are to be connected thereto. In this drawing, the pedestal or chassis 7 which consists of metal can be seen from the upper side 7*a*, and as a result it is also clear that the pedestal or chassis 7 is provided not only with the aforementioned peripheral pedestal rim 7*c*, but also further with a plurality of pedestal bridges 7*d*, which rise from the floor 7*b* and are generally orientated perpendicular thereto and which divide the actual component space 12 into different component spatial regions 12*a*. The spatial regions 12*a* are thus separated from one another by the shielding bridges 7*d* (which form part of the pedestal 7 and therefore also consist of or are covered in conductive material).

Simply by looking at the drawing of FIG. 4, it can be seen that a foot part or anchoring part 17 is formed projecting downwards on the pedestal underside 7*e*, that is to say on the underside of the pedestal floor 7*b*, and is connected to the entire pedestal as one piece (specifically in a material fit), for example as an integrated metal part. In this context, the foot part or anchoring part 17 can also be formed separately from the actual pedestal 7 and be mechanically and galvanically connected thereto. The entire arrangement and the construction of the pedestal and the foot part or anchoring part 17 can therefore also be configured in a plurality of parts, in which case the individual parts should be mechanically and galvanically connected, in such a way that, like the pedestal, the foot part or anchoring part not only brings about shielding, but also simultaneously acts as an external conductor.

Figure 5:
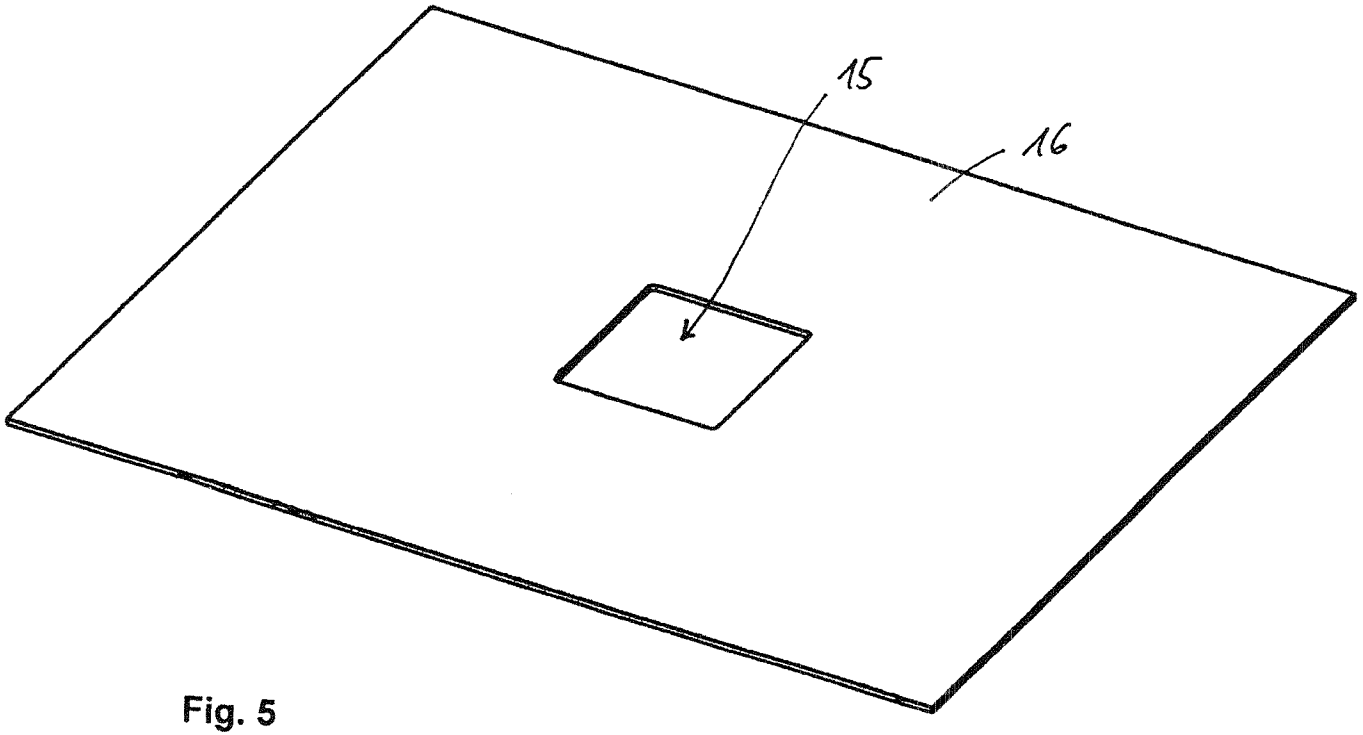
FIG. 5 is a partially three-dimensional drawing of vehicle body sheet metal (of the motor vehicle outer skin) comprising a mounting opening formed therein for attaching the motor vehicle rooftop antenna.

During the final mounting in the motor vehicle, the foot part and anchoring part 17 of the antenna formed in this manner is placed on a roof of a motor vehicle, the foot part or anchoring part 17 which projects downwards past the pedestal floor subsequently penetrating through a mounting opening 15 shown in FIG. 5, generally in the roof of a motor vehicle and thus generally in what is known as a motor vehicle outer skin 16, and projecting into the interior of the motor vehicle.

From the drawings of FIGS. 1 to 4, it can already be seen that a plurality of coaxial conductors extend from the printed circuit board underside 9*c*, in the embodiment shown (see FIGS. 1 and 2) three coaxial conductors 21 which are arranged side by side.

Each of these coaxial conductors 21 comprises an internal conductor 23, a dielectric 25 which encloses the internal conductor and in the embodiment shown is stepped in the longitudinal direction, and an external conductor 27 which accommodates the dielectric 25.

In the embodiment shown, the respective external conductor 27 is provided on the side thereof facing the printed circuit board 9 with four feet or pins 27*a*, which are mutually offset in the circumferential direction of the cylindrical external conductor, project counter to the plugging and joining direction (Z) (that is to say perpendicular to the printed circuit board), and engage in and are soldered in corresponding holes at a connection point on the printed circuit board 9.

The internal conductor 23 generally also penetrates a corresponding hole in the printed circuit board, or the internal conductor end face thereof is positioned directly on the printed circuit board underside 9*c*, where said conductor is soldered to a corresponding contact point.

In this way, the internal conductor 23 and the external conductor 27 of the respective coaxial conductor 21 are thus galvanically connected to the printed circuit board. As a result of this connection, the respective coaxial line 21 is electrically contacted and mechanically held, primarily because the external conductor 27 is configured as a metal cylinder or metal tube and is not only galvanically connected, but also mechanically fixed, to the printed circuit board in a rigid and stable manner as a result of the plurality of anchoring feet or pins 27*a* thereof positioned offset in the circumferential direction, and thus holds the entire coaxial conductor 21 orientated comparatively stably on the printed circuit board 9.

Figure 6:
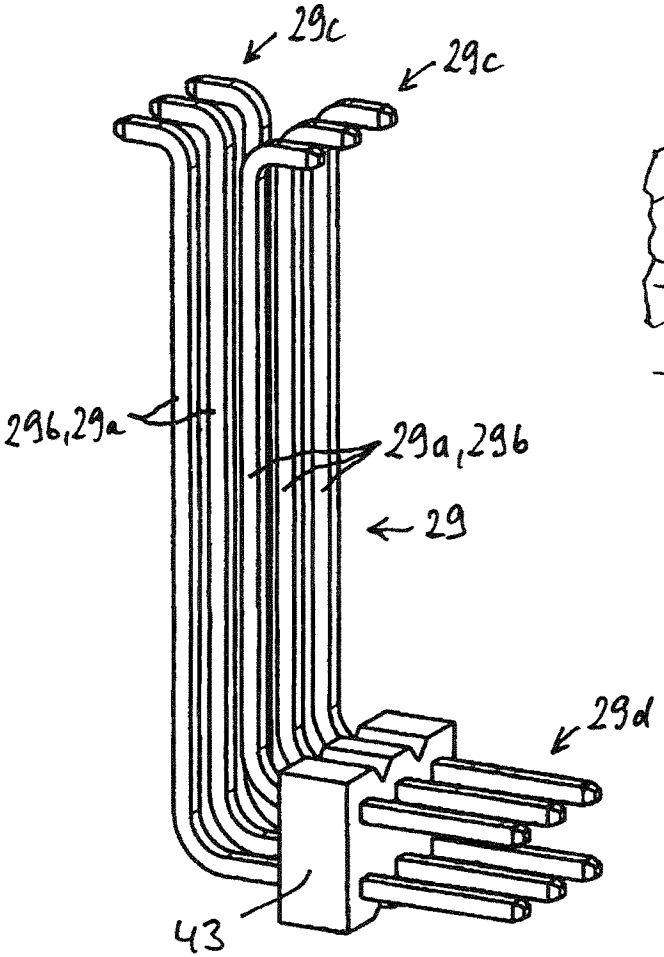
FIG. 6 is a three-dimensional drawing of a bus connection consisting of six individual lines.

Furthermore, in the embodiment shown, a further bus connection 29, that is to say for example a bus 29 in the form of a plurality of data lines 29*a*, is also provided, and in the embodiment shown consists of six individual wires or individual lines 29*b* held at a distance from one another, as is shown for example by way of FIG. 6. The terms "bus" and "bus connection" as used in the following, or in some cases also "bus structure", refer to an unshielded data line, that is to say an unshielded signal line and/or power supply which comprises at least one and preferably a plurality of individual data lines. The six individual lines 29*b* of this data bus 29*a* in the embodiment shown (which are formed in two rows each of three individual lines 29*b* positioned side by side) is attached directly adjacently alongside the three coaxial lines 21.

In practice, the aforementioned data lines 29*a*, 29*b* of the bus 29 serve to transmit signal or current, and the aforementioned coaxial lines 21, in particular the internal conductor 23, serve to transmit the high-frequency signals (HF signals), specifically for transmitting the various services.

Figure 7:
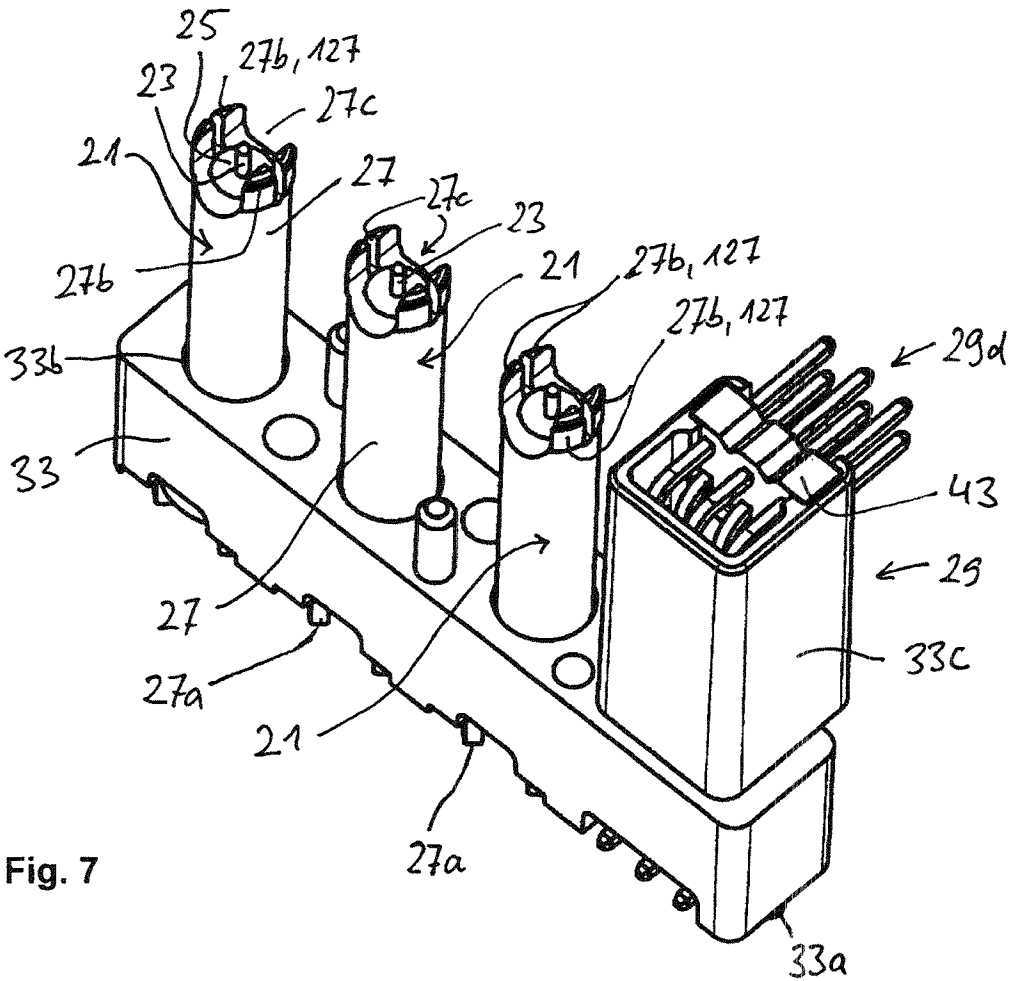
FIG. 7 is a perspective view of three coaxial lines and a data connection, which are held mechanically by means of a holding block.
Figure 8:
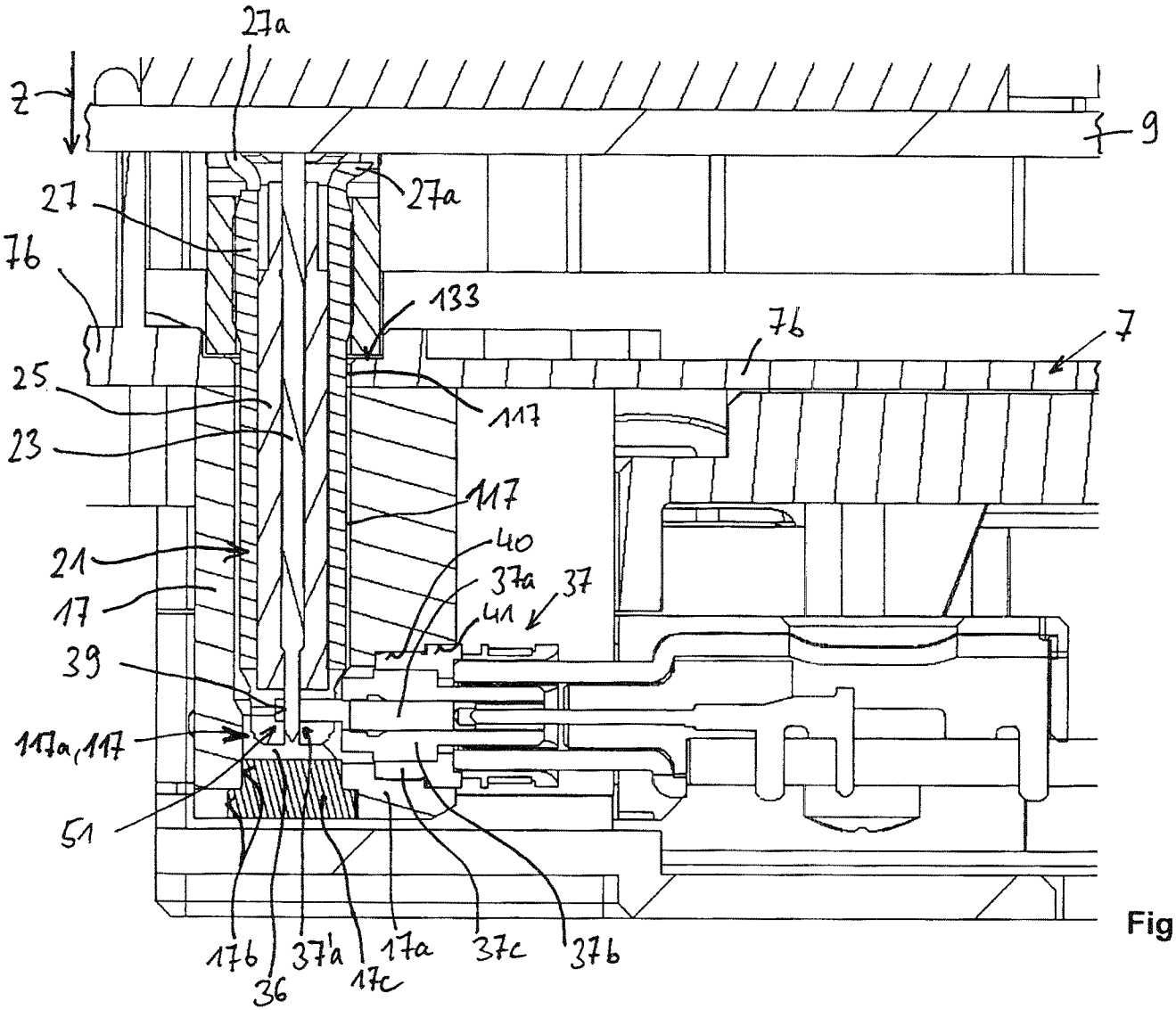
FIG. 8 is a cross-sectional view through the parts of the antenna according to the invention and the internal unit coupled thereto, specifically in the form of a cross-sectional drawing through a coaxial conductor comprising a coupling means which is connected to a corresponding coupler of the internal unit.
Figure 9:
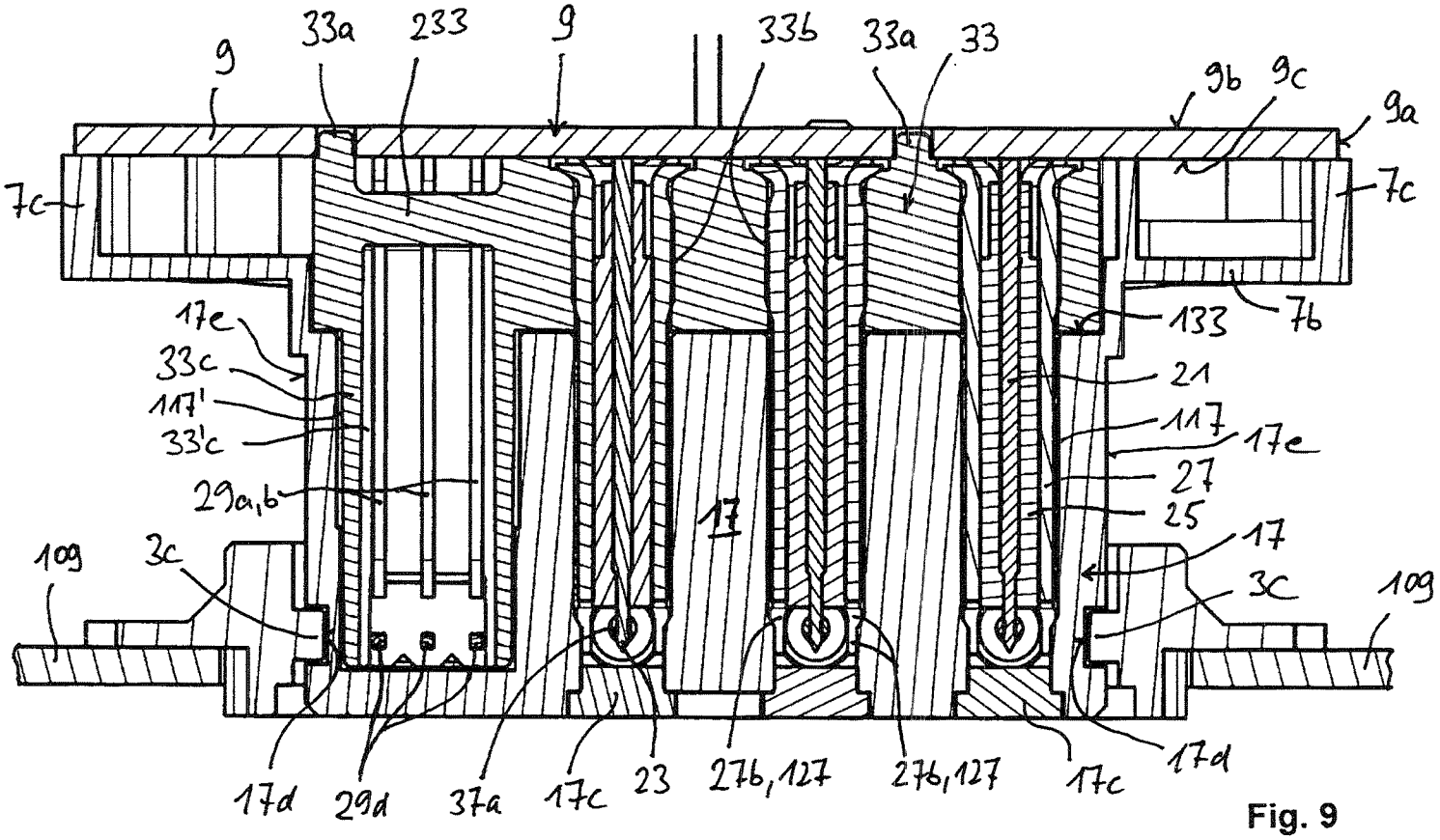
FIG. 9 is a cross-sectional view perpendicular to the sectional drawing of FIG. 8, specifically in a plane which extends through the internal conductors of the coaxial lines arranged side by side.

In the following, reference is further made in particular to FIGS. 7, 8 and 9, FIG. 7 being a perspective view from below of the three coaxial lines 21 positioned side by side and of the data connection 29 arranged alongside, these coaxial lines and the data connection additionally being arranged, held and fixed in a corresponding holding block 33, discussed in greater detail below. In this context, FIG. 8 is a cross-sectional drawing through an individual coaxial conductor as finally arranged and mounted when installed. FIG. 9 is a further sectional drawing perpendicular to the sectional drawing of FIG. 8, specifically in a sectional plane which in each case extends through the central axis, that is to say the internal conductor 23 and the data connection 29*a*, that is to say a sectional drawing in the longitudinal direction through the holding block 33.

As can thus be seen from the drawings, the individual coaxial lines 21, that is to say the external conductors 27 of the coaxial lines 21, are additionally held and adjusted adjacent to the printed circuit board by a holding block 33, this holding block preferably consisting of a plastics material part, that is to say of an electrically non-conductive insulator. On the side remote from the printed circuit board 9, this holding block 33 comprises a row of projecting feet, pins or ribs etc. 33*a*, which can likewise engage in corresponding holes in the printed circuit board 9, and thus secure the block 33 against displacement or twisting. This is also how the coaxial lines 21, which penetrate corresponding holes 33*b* in the holding block 33, are additionally secured and held against lateral displacement or deformation or twisting with respect to one another, but also against displacement or deformation or twisting of the entire arrangement thereof as a whole.

The printed circuit board which is prepared and equipped in this manner, comprising the downwardly projecting coaxial lines 21, the bus connection 29 and the holding block 33, is subsequently placed on the chassis or pedestal 7 until the holding block 33 engages in a corresponding depression 133 in the pedestal floor 7*b*, this depression 133 in the pedestal floor 7*b* having a longitudinal extent, transverse extent and shaping which at least largely correspond to the longitudinal extent, transverse extent and shaping of the holding block 33, in such a way that, in other words, part of the peripheral contour of the holding block engages in and is held undisplaceably and untwistably in the corresponding depression 133 in the pedestal floor 7.

During this plugging and joining process in the Z direction, in this context the coaxial lines 21 which project past the holding block 33 in the joining direction Z and the holding block extension 33*c* which likewise projects past the holding block 33 (and which comprises in the interior a longitudinal duct which is penetrated by the bus connection 29, resulting in the bus connection additionally being protected, as is discussed further below) are inserted into correspondingly vertically extending and mutually shielded ducts 117 and 117' in the foot part 17. Thus, in other words, the coaxial lines 21 and the data connections 29 project through corresponding openings or holes in the pedestal floor 7*b*, that is to say project into ducts 117 and 117' which proceed in the region of the depression 133 in the pedestal floor 7*b* and which penetrate the pedestal floor and the floor part and/or anchoring part 17.

In this context, the projecting ducts 117 which extend from top to bottom in the foot part could be configured tapering downwards at least slightly (in particular even if the pedestal is produced together with the foot part as a cast part), the sizing being such that the contacting portion 27*b* of the external conductor 27 of the coaxial conductor 21 (which portion can even be made slightly wider than the remainder of the external diameter) runs up the inner wall of the duct 117, which tapers in the insertion direction, in the foot part 17 and at the end of the insertion movement ensures a galvanic connection, implemented while creating sufficient contact forces, between the external conductor 27 and the foot part 17 which consists of metal, and thus the pedestal 7 as a whole. A corresponding cross-sectional drawing through a coaxial conductor 21 comprising the associated internal conductor, the dielectric and the external conductor, when still arranged in a corresponding duct 117 in the foot part 17 before mounting, can be seen in FIGS. 8 and 9.

In the embodiment shown, the coaxial line 21 is fixed and the external conductor 27 is galvanically connected by way of mechanical and galvanic contact through the leading end portion of the contact rim 27*b* (see FIG. 8), the contact rim 27*b* lying pressed in against the inner wall of the cross-section, which is tapered in this region, of the ducts 117 so as to produce sufficiently high clamping forces. However, it is also possible for the leading contact rim to comprise a plurality of slots or recesses 27*c* (see FIG. 7), which are mutually offset in the peripheral direction and which are formed over part of the length of the peripheral rim, specifically so as to form at least slightly springy contact fingers 127, which subsequently lie with a corresponding high gripping force against the inner wall of the lower end 117*a*, which in this embodiment is formed with a smaller diameter, of the duct 117.

By way of this arrangement, a high mechanical strength and reliability are ensured as regards the fixing and holding of the respective coaxial conductor 21 in an associated duct 117 in the foot part 17 of a pedestal 7. In addition, this results in an optimal galvanic contact being produced between the respective external conductor 27 of a coaxial conductor 21 and the foot part 17 consisting of metal and thus the pedestal or chassis 7 as a whole, the mutually separated ducts 117, in which the external conductors 27 of the coaxial lines 21 are positioned pressed in, additionally providing optimal shielding between the individual coaxial lines and with respect to the duct 117' accommodating the bus 29.

If tolerance errors also occur during production, that is to say during the positioning and production of a soldered connection between the internal conductor 23 and the printed circuit board 9 or the external conductor 27 and the printed circuit board 9, the insertion and joining movement of the external conductor 27 into the corresponding ducts 117 in the foot part 17 of the pedestal 7 also ensures a corresponding compensation of any tolerance errors which are present, ensuring high-precision overall production and positioning of the lower free ends of the internal conductors 23 of the individual coaxial lines 21.

In the embodiment shown which has been discussed thus far, the rooftop antenna 1 is to be configured in such a way that an optimally configured direct connection by plugging is made possible between the rooftop antenna 1 and the internal unit 3 in the form of the aforementioned electronic component 3, specifically while simultaneously minimising the required mounting hole and the joining space below the vehicle outer skin (that is to say generally the roof).

In this way, in the context of the aforementioned electronic component 3, the internal unit 3 may generally likewise comprise a further printed circuit board 109 (see FIG. 4), which in the arrangement shown comes to be positioned parallel to the first printed circuit board 9 which is accommodated in the antenna housing 5, the first printed circuit board 9 coming to be positioned outside the vehicle outer skin 16 (that is to say the roof), and the internal unit 3 coming to be positioned below the vehicle outer skin 16 and thus in the interior 116 of the motor vehicle directly adjacent to the vehicle outer skin 16.

In the context of the invention, a planar construction is made possible primarily if the internal unit 3 can be connected to the corresponding terminals of the coaxial cable and the data bus not in the plugging and joining direction Z, that is to say perpendicular to the printed circuit boards 9, 109, but in a plugging, joining or displacement direction S extending transverse or especially perpendicular thereto. In this context, this plugging, joining or displacement direction S preferably extends perpendicularly or radially with respect to the coaxial longitudinal extent of the coaxial conductors 21 and thus of the foot part 17 or of the ducts 117, that is to say generally parallel to the aforementioned printed circuit boards 9 and 109. Of course, if required, particular small angular deviations from this can be implemented, if desired.

In this context, simply from the drawings of FIGS. 1 to 4 and 6 to 8, it can be seen that the lower ends of the individual coaxial lines 21 each comprise a coupler or plug-type connector 37, which is horizontal and thus extends parallel to the printed circuit boards 9, 109, and which comprises an internal conductor 37*a* and an external conductor 37*b*, which may be configured in the form of a plug or a socket.

For reasons of concentricity, that is to say the coaxial arrangement between the internal and external conductors of the coaxial conductor 21, it is not possible to insert a single-piece or continuous internal conductor having a 90° bend into a similarly single-piece or continuous external conductor. Therefore, in the context of the invention, the internal and external conductor and the dielectric are separated into mutually transversely extending components, that is to say in particular mutually perpendicularly extending components, the coaxial lines generally extending more or less vertically when mounted and therefore being referred to in the following as "vertical components" for short, the components which can be connected to the internal unit being referred to in the following as "horizontal components" for short, even though the aforementioned components are not, or need not, be orientated exactly vertically or horizontally or even necessarily be orientated mutually perpendicular when mounted, but may instead be orientated deviating from this by a slight angle. As stated above, the components may also be orientated at an angle other than 90° if required, for example at an angle of 85° to 95° etc. There are basically no restrictions in this regard.

A special construction is therefore proposed here, and is also clarified in particular in the sectional drawing of FIG. 8.

From this drawing, it can be seen that below the aforementioned coaxial conductor 21 the dielectric 25, which generally consists of a plastics material (and thus not of air), stops directly before the 90° angular connection 51 in each case, where an internal conductor 37*a* starts in each case and in the embodiment shown extends perpendicularly or radially with respect to the coaxial conductor 21 and is preferably part of the coupler 37. In this context, in the embodiment shown, the diameter of the associated internal conductor 37*a* is configured with a larger diameter, at least in the attachment and/or connection region 37'*a* of the internal conductor 37*a*, than the diameter of the internal conductor 23 of the respective coaxial conductor 21. Therefore, in the attachment and connection region 37'*a* thereof, the internal conductor 37*a* can be provided with a hole or slot 39 or the like, which in the embodiment shown is radial and thus extends perpendicular to the axial extension of the internal conductor 37*a*, and into which a respectively associated internal conductor 23 of a coaxial conductor 21 engages when mounted, penetrating this hole 39 and thus ensuring a good galvanic connection between the internal conductor 23 of the coaxial conductor 21 and the internal conductors 37*a* associated with the coupler 27.

Instead of the aforementioned holes 39, any suitable opening is possible, for example including in the form of a slot which is formed in the relevant internal conductor 37*a* and preferably penetrates the entire thickness thereof.

Since, as stated, the coaxial internal conductor 21 is orientated and held very precisely positioned (even if tolerance errors are originally present in relation to the connector of the coaxial conductor 21 to the printed circuit board 9) primarily by positioning in the aforementioned ducts 117 which penetrate the foot part 17, this method makes it possible for the external conductors 37*c* of the aforementioned couplers 37 initially preferably to be pressed into corresponding transverse holes 40, 41 at the lower end of the foot part 17, the internal conductors of these couplers 37 subsequently being orientated in such a way that the hole 39 (or a corresponding slot or the like), which is provided in the connection region 37'*a* and penetrates the internal conductor 37*a*, comes to be positioned in a direct axial direction with respect to the internal conductor 23 of the coaxial lines 21. By sinking or joining the printed circuit board 9 comprising the coaxial line 21 connected to and held on the printed circuit board underside 9*c*, on the one hand the aforementioned galvanic connection between the external conductor 27 of the respective coaxial conductor 21 and the internal surface of the associated duct 117 in the foot part 17 is ensured, and on the other hand the respectively associated internal conductor 23 is galvanically connected to the associated internal conductor 37*a* of the coupler 37 through the hole 39.

So as to carry out the mounting and the mechanical and galvanic connection between the internal conductors 23 and 37*a*, the foot and anchoring part 17 comprises, in the axial extension of the ducts 117, an elongate hole 17*b*, which penetrates the floor 17*a* of the foot and anchoring part 17 and which makes open access possible there for also producing the connection between the internal conductors during the production process (joining movement). Subsequently, this hole 117 can be sealed using a corresponding cap 17*c*, which can either be pressed in or screwed in if there is a thread. This cap 17*c* should likewise again consist of electrically conductive material, preferably metal or metal alloy, or at least of an electrically conductive plastics material, or at least be provided with a correspondingly conductive outer layer which provides shielding and which thus also simultaneously forms part of the external conductor as a whole, as a result of the galvanic contact with the remainder of the foot and anchoring part 17.

It can also be seen from the cross-sectional drawing of FIG. 8 that no dielectric consisting of plastics material is provided in the region of the attachment connection 37'*a*, but in this case a dielectric 36 in the form of air is used instead. This is followed by the dielectric 37*b* of the coupler 37, so as to hold the internal conductor 37*a* in the coupler 37.

Even throughout the entire region of the coupler 37, the external conductor and thus the shielding are also formed by the foot part 17, consisting of metal, of the pedestal 7.

As stated above, the transverse holes 40, 41 provided at the lower end of the foot part 17 for accommodating the coupler are made stepped, a correspondingly stepped shoulder of the external conductor 37*c* engaging here. As stated, in this context the external conductors of the couplers 37 are preferably pressed into the corresponding transverse hole 40, 41 which is stepped here, ensuring a good mechanical connection on the one hand and optimal galvanic contact on the other hand. This also leads to the possibility of orientating the coupler in such a way that the hole 39, formed before the insertion into the foot part 17, in the internal conductor 37*a* in the connection region 37'*a* is orientated exactly in such a way that the central axis of this hole is flush with the central axis of the internal conductor 23 of the coaxial line 21, which is to engage in this hole 39 during the joining process. In this context, the aforementioned axial orientation of the stepped hole 40, 41 in the foot part 17 is provided in such a way that the central axis of this transverse hole 40, 41 is orientated radially and preferably perpendicularly with respect to the relevant coaxial conductors 21 and thus with respect to the relevant plugging and receiving ducts 117 in the foot part 17.

In principle, it is noted that the couplers could also be provided with an external thread which engages in a corresponding internal thread in the stepped hole 40, 41. However, additional measures would also be required so as to ensure that the hole 29 at the end of the associated internal conductor 37*a* is exactly orientated in this case, so as to be penetrated by the internal conductor 23 of the coaxial line 21 during the joining process.

The bus connection 29, comprising the six individual lines 29*b* in the embodiment shown, has already been described by way of FIG. 6.

Each of these individual lines 29*b* comprises terminal ends 29*c* on the printed circuit board side, which are bent through 90° in such a way that these terminal ends 29*c* respectively form parallel elbowed portions, positioned side by side, which are orientated extending away from one another with respect to the two rows in which the individual lines 29*a* are arranged.

At these terminal ends 29*c*, the individual lines can be soldered at corresponding soldering points so as to be galvanically separated from one another at the relevant connection points on the underside 9*c* of the printed circuit board 9.

In the vicinity of the elbowed terminal ends 29*c*, the holding block 33, preferably consisting of plastics material, may further be provided with a transverse bridge 233 (see FIG. 9), resulting in the formation of two adjacent openings which are separated from one another by the transverse bridge 233. One group of three data lines 29*b* (the elbows 29*c* of which all point in one direction) extend through one opening, whilst the other three data lines 29*b* (the elbows 29*c* of which all point in the other direction) extend through the other opening.

In addition, at least one holding and fixing block 43 is provided, which in the embodiment shown comprises six holes, which are penetrated by the individual lines 29*a*. In the embodiment shown, this fixing and holding block 43—which consists of an insulator, preferably of plastics material—is arranged after a 90° elbow 45 of the individual wires 29*b* in such a way that the terminal ends 29*d*, which extend parallel to the printed circuit boards 9, 109 and are positioned in the interior of the vehicle, are held at a non-touching distance from one another.

Reference has already been made to the holding block 33, which holds the coaxial lines 21 rigidly in corresponding holes 33*b*. On one transverse side thereof, this holding block 33 comprises a holding block potion 33*c*, which extends over a greater length or height in the plugging and joining direction Z and which is provided with an internal duct 33'*c*, which is preferably approximately rectangular in cross-section and which serves to accommodate the bus connection 29 comprising the six individual lines 29*a* in the embodiment shown.

If a prepared printed circuit board 9, comprising the coaxial conductors 21, the bus connection 29 and the holding block 33 which fixes the aforementioned lines, is placed on the pedestal 9 in such a way that the coaxial lines 21, which project past the holding block, and the holding block extension 33*c* comprising the bus connection 29 penetrate the ducts 117, 117' in the foot part 17, which are formed in the pedestal 7 and the associated foot part 17, in a shielded manner in the plugging and joining direction Z (the internal conductors 23 of the coaxial conductors 21 thus being galvanically contacted with the internal conductors 37*a* of the couplers 37), a construction is obtained comprising for example three coaxial couplers 37 positioned side by side and a bus terminal structure 137 in the form of a multiple line coupler 137, which are all orientated in a direction parallel to the printed circuit boards 9 and 109. This thus provides the possibility of the aforementioned internal part 3, which is formed in the manner of an electronic component, being able to be connected directly, in a plugging or displacement direction S extending parallel to the printed circuit boards 9, 109, to the interfaces of the motor vehicle antenna which are thus formed.

For this purpose, as can be seen from the drawings, the internal component 3 likewise comprises couplers 47 which are arranged at a corresponding point at the same axial distance from one another as the couplers 37 in the foot part 17, in such a way that the internal part 3 can be plugged onto the corresponding interfaces of the antenna in accordance with the plugging, joining or displacement direction S and subsequently be dielectrically connected. Similarly, a corresponding bus interface 147 is provided in the internal module 3, that is to say a further coupler 147, for example comprising socket-shaped plug recesses into which the terminal ends 29*d*, extending parallel to the printed circuit board 109 and thus parallel to the plugging, joining or displacement direction S, of the bus connection 29 can be introduced and electrically contacted and thus connected.

In this context, for completeness, reference is also further made to FIGS. 10*a* and 10*b*, FIG. 10*a* being a detail of the foot part 17 comprising the couplers 37 and the data coupler 137 for the data connection which is integrated into the chassis. FIG. 10*b* shows a corresponding socket plug 147, which is formed on the internal unit 3 and can be assembled with the plug housing of the coupler 137 for the data connection when mounted.

In this context, the internal module 3 may comprise further interfaces for example in the form of further couplers 53, which can be seen for example in the drawings of FIGS. 2 and 3. Corresponding cables, in particular coaxial cables, can be connected thereto, which lead to other components in the interior 116 of the motor vehicle, for example to a hands-free system of a telephone, to a radio, to a microprocessor having a connected display for a navigation device etc.

In the embodiment shown, the foot part 17 which can be plugged through the mounting opening 15 in the motor vehicle outer skin 16 (that is to say the body sheet metal of a motor vehicle) comprises guide elements 17*d* (FIG. 1), which are attached to the two opposite transverse sides 17*e* of the foot part 17, that is to say to the outer sides 17*d* opposing through 90° on the foot part 17, which are orientated transverse and in particular perpendicular to the plugging, joining or displacement direction S. In this context, the internal part 3 comprises, in the leading side thereof in the plugging, joining and displacement direction S, an internal recess 103 comprising two side delimitations or generally lateral guide means 3*c* (FIG. 4) which project into the recess 103, extend in the displacement direction S, and when mounted cooperate with the aforementioned guide means 17*d* on the foot part 17. Thus, in other words, sliding on and electrically connecting the motor vehicle internal part 3 to any further electronic components provided on the foot part 17 simultaneously also results in a mechanical, positive connection between the connection region of the internal component 3 and the foot part 17 which projects downwards in the interior 116 of the motor vehicle, and thus to the antenna 1 as a whole, in such a way that the antenna 1 can thus no longer be removed upwards counter to the plugging and joining direction Z.

It can thus be seen from the description of a preferred embodiment of the invention that the central idea is to produce a plug-type connection directly between two printed circuit boards, which are arranged with a vertical offset V and can be assembled with a parallel joining direction S. In this context, one printed circuit board is accommodated in the antenna arrangement on the outside of the motor vehicle, it being possible for the second printed circuit board to be provided in the internal part 3 accommodated on the inside of the vehicle. In this context, the described connection elements required for this purpose are elbowed through 90° proceeding from the antennae. The resulting transitions from the horizontal into the vertical orientation and from a coaxial structure to a microstrip structure which may potentially be provided (in the region of the printed circuit board accommodated in the internal part 3) can be adapted by optimising the construction inside the coaxial structure and in the region of the transition from the internal conductors to the conductor path on the printed circuit board, specifically for example for a frequency range up to 6 GHz, for example at an impedance of 50 ohms.

For this purpose, as stated, the dielectric can be replaced with air entirely or in part in the coaxial region, it being possible for the diameter of the internal conductor to be adapted here too. In this context, the transition region to the printed circuit board can be optimised accordingly by way of the configuration of the external conductor and the construction of the layout.

What is known as the "vertical region" comprises the printed circuit board 9 in the antenna housing 5 comprising the internal conductors 21 proceeding from the printed circuit board 9 (even though they need not necessarily extend vertically, but are merely referred to as the "vertical part" for short for simplicity) and the printed circuit board equipment, the aforementioned block or plastics material carrier 33 and the SMD-capable internal conductors 23, which are positioned vertically on the printed circuit board 9 of the antenna module and are enclosed by the dielectric 25 and the external conductor 27. In this context, the external conductor 27 has the aforementioned foot points or pins 27*a*, which are soldered to the printed circuit board 9.

What is known as the "horizontal region", in the form of the connection structure which is orientated more or less horizontally and thus radially with respect to the vertical region, using the couplers 37, is distinguished inter alia in that in this context the chassis is used with the foot part as shielding and as an external conductor. For this purpose, as stated, part of the chassis in the form of what is known as the foot part 17 is extended downwards by way of the mounting hole 15 in the motor vehicle outer skin 16 and projects into the interior 116 of the motor vehicle. In this context, this downwardly extended part of the chassis 7 in the form of the foot part 17 simultaneously serves as a carrier for the plug sockets of the coupler 37. In this context, the plug sockets in turn consist of an external conductor 37*b* and an internal conductor 37*a*, the couplers prepared in this manner subsequently being pressed into a corresponding stepped hole 39 in the chassis and thus producing the desired contact for the shielding.

The connection between the vertical and horizontal regions is produced when the equipped printed circuit board (including the plug block) is connected to the chassis, the leading end of the internal conductor 23 (that is to say of what is known as the vertical region) penetrating into and through the corresponding internal conductor hole 39 in the coupler 37 (that is to say in the horizontal region) in this joining step.

The embodiment explained by way of FIGS. 1 to 10*b* is shown simplified in a schematic cross-sectional drawing by way of FIG. 11*a* and in a further drawing, FIG. 11*b* (FIG. 11*b* being a sectional drawing along the line XIb-XIb in FIG. 11*a*), from which the transverse offset V between the two printed circuit boards 9, 109 can also be seen. In FIG. 11*a*, the internal unit 3 is shown before connection in solid lines and when connected in dashed lines.

In this context, the vertical and horizontal regions of the means belonging to the antenna are shown, and ultimately form a first plug half A on the antenna module side, which can be mechanically and electrically connected to a plug half B in the joining direction S, with the 90° elbowing.

During the aforementioned joining step along the joining direction Z, the external conductors 27 of what is known as the vertical region are pressed into the ducts 117 of the chassis 7 and thus of the foot part 17, and thus form a galvanic connection. The contact of the internal conductor is produced in that the tapered part of the respectively leading end of the internal conductor 23 is pressed into the slotted part of the other internal conductors, which lead to or belong to the coupler 37. There is air in the region of the connection of the internal conductor as a dielectric.

The foot part 17, extended downwards through the mounting hole 15, of the antenna chassis 7 additionally has features which on the one hand guide the components during the joining process and on the other hand mechanically relieve the electric components such as the printed circuit board 9 when they are fully guided through.

Via the foot part comprising the chassis 7, a mechanically stable connection is produced between the inner and outer units, that is to say between the electric assembly provided as an inner unit 3 and the outer unit in the form of the motor vehicle antenna 1.

By way of the embodiments so far, a variant has been disclosed in which, with a minimal construction height, a radial and in particular parallel connection possibility is implemented parallel to the pedestal or to the printed circuit board, mounted on the pedestal 7, of an antenna mounted on the outside of a motor vehicle, in such a way that an internal part, located in the interior 17 of the motor vehicle and comprising further electronic components, can be connected in an extremely simple manner in a displacement direction S extending parallel to the printed circuit boards 9, 109.

By contrast, in different applications, the described 90° angle connection can be dispensed with, in such a way that a coaxial or bus connection variant is provided which extends counter to the plugging or joining direction Z in the interior of the motor vehicle.

This is shown purely schematically by way of FIGS. 12*a* and 12*b* (comparable to the drawings of FIGS. 11*a* and 11*b* for the other embodiment) in a corresponding drawing in which the corresponding couplers 37 are now pressed into corresponding holes in the foot part 17 from below counter to the plugging and joining direction Z, the internal conductors 37*a* of the couplers 37 coming to be positioned in the axial extension of the internal conductors 23 of the associated coaxial lines 21 in this embodiment. In this case, axial blind holes, into which the leading terminal ends, preferably also tapered in this manner, of the internal conductors 23 could be introduced and preferably pressed during the joining process, could be formed on the end faces of the internal conductors 37*a*, configured with a larger diameter, of the couplers 37.

Likewise, a bus coupler which can be plugged on counter to the plugging and joining direction Z may be connectable, the bus connection 29 in this embodiment merely comprising individual wires 29*b* which end extending straight proceeding from the printed circuit board 9, without any curvature 45, that is to say in the plugging and joining direction Z.

In this case too, the individual wires 29*b* would be fixed mechanically at a distance from one another by way of a block 33, which consists of a non-conductive material, preferably plastics material (dielectric), reference finally also further being made to FIG. 9, which is a cross-section along the line IX-b-IXb in FIG. 9*a*.

The invention claimed is:

1. Rooftop antenna, comprising:

a plug-type connection device, a pedestal, a printed circuit board arranged on the upper side of the pedestal, one or more antennae provided on the upper side of the printed circuit board, at least one coaxial line provided on the underside of the printed circuit board, extending away transversely and perpendicularly therefrom, the at least one coaxial line comprising an internal conductor, which is enclosed by a dielectric which is enclosed by an external conductor, the external conductor comprising an external conductor cylinder, which on the printed circuit board side is electrically connected and mechanically anchored to the underside of the printed circuit board, the internal conductor electrically conductively connected to the printed circuit board, the pedestal comprising an electrically conductive material or coated with an electrically conductive material, the pedestal comprising a projecting pedestal foot part on the pedestal underside thereof, the pedestal foot part being formed in a single piece with the remainder of the pedestal or connected thereto, and being coated with an electrically conductive layer electrically conductively or together with the pedestal, the pedestal foot part comprises a duct for receiving the at least one coaxial line, the duct penetrating the foot part transversely and perpendicular to the pedestal base in a plugging and joining direction (Z), the coaxial line being inserted into the at least one duct of the pedestal foot part in such a way that at least one portion of the outer periphery of the external conductor of the coaxial line is mechanically pressed onto and thus galvanically contacted with the electrically conductive inner wall of the duct of the pedestal foot part, and alongside the at least one coaxial line, a bus connection is provided extending parallel thereto and comprising a plurality of individual lines, which extend mutually parallel and are accommodated in a separate duct which penetrates the pedestal foot part.

2. Rooftop antenna according to claim 1, further comprising a plurality of coaxial lines arranged mutually parallel and are provided extending away from the underside of the printed circuit board in an orientation perpendicular to the plane (E-LP) of the printed circuit board, each of the coaxial lines penetrating a separate duct of the plurality of ducts which extend separated from one another mutually parallel in the pedestal foot part.

3. Rooftop antenna according to claim 1, further comprising at least one further duct provided in the foot part, separately from the other ducts, and is penetrated by a bus connection.

4. Rooftop antenna according to claim 3, wherein the bus connection comprises a plurality of individual lines which are arranged side by side in a parallel orientation and held by an electrically non-conductive holding block, which comprises a row of individual holes which are penetrated over part of the length by the individual lines.

5. Rooftop antenna according to claim 4, wherein the ends of the individual lines on the printed circuit board side comprise terminal ends, in the form of elbowed line ends, which are soldered to the printed circuit board.

6. Rooftop antenna according to claim 1, wherein a holding block is provided, which comprises at least one or more holes or ducts through each of which a coaxial conductor is passed, which is thus fixed and stabilized.

7. Rooftop antenna according to claim 6, wherein the holding block is anchored onto the underside of the printed circuit board via feet, pins or ribs which project on the printed circuit board side.

8. Rooftop antenna according to claim 6, wherein a recess or depression, into which at least part of the height of the holding block dips so as to be at least one of undisplaceable and untwistable, is formed in the pedestal bottom of the pedestal.

9. Rooftop antenna according to claim 6, wherein at least one of (a) the at least one coaxial conductor and (b) the data connection project on the side of the holding block remote from the printed circuit board, the portions of the at least one coaxial line which project past at least one of the holding block and a holding block extension of the holding block being arranged with the data connection extending therein in a relevant duct in the foot part.

10. Rooftop antenna according to claim 1, further comprising a coupler comprising a coupler internal conductor, the coupler internal conductor of which coupler is connected to the internal conductor of the coaxial line, is connected to the end opposite the printed circuit board, of the at least one coaxial line, the external conductor of the coupler being mechanically inserted into, and galvanically connected to, a hole in the foot part.

11. Rooftop antenna according to claim 10, wherein the external conductor of the coupler is pressed or screwed into a hole in the material of the foot part.

12. Rooftop antenna according to claim 10, wherein the internal conductor of the coupler is held by a dielectric which encloses the internal conductor.

13. Rooftop antenna according to claim 10, wherein the longitudinal extension of the coupler is orientated radially, transversely and perpendicularly with respect to the axial extension of the associated coaxial line.

14. Rooftop antenna according to claim 1, further comprising an elbow connection, which leads to the coupler, provided on the end opposite the printed circuit board of the coaxial line, the coupler being orientated radially, transversely and in particular perpendicularly with respect to the axial extension of the coaxial line.

15. Rooftop antenna according to claim 14, wherein the internal conductor of the coupler comprises an opening, in the form of a hole or slot, which extends radially with respect to the longitudinal extension thereof and is penetrated by the internal conductor of the coaxial line when mounted.

16. Rooftop antenna according to claim 10, wherein the internal conductor of the coupler and the internal conductor of the coaxial line extend in the foot part, which serves as at least one of shielding and as an external conductor of the coaxial line.

17. Rooftop antenna according to claim 14, wherein a connection region between the internal conductor of the coupler and the internal conductor of the coaxial line is enclosed by air as a dielectric.

18. Rooftop antenna according to claim 10, wherein an internal part of the correspondingly configured interfaces can be connected to at least one of (a) the at least one coupler and (b) the terminal ends of the bus, the internal part comprising a printed circuit board, the plane of which is orientated parallel to the axial extension of the coupler.

19. Rooftop antenna according to claim 18, wherein the internal part can be contacted by means of a plugging and joining movement extending parallel to the printed circuit boards.

20. Rooftop antenna according to claim 18, wherein an internal part can be plugged onto at least one of (a) the at least one coupler and (b) a bus terminal by means of a connection movement extending perpendicular to the printed circuit board.

21. Rooftop antenna according to claim 18, further comprising a fixing means for fixing the pedestal foot part, the fixing means comprising a guide means, on the two opposite side walls of the foot part, said guide means cooperating with a corresponding guide means of the internal part when mounted, in such a way that the guide means of the internal part can be plugged on transversely and radially with respect to the longitudinal extension of the foot part.

22. Rooftop antenna according to claim 10, wherein the coupler is connected positioned, and pressed in, opposite the printed circuit board in the axial extension of the at least one axial line in a hole of the foot part.

23. Rooftop antenna according to claim 1, wherein an opening or hole is formed in the foot part in the axial extension of the at least one coaxial line, and is sealed with a protecting cap, which is covered with an electrically conductive layer, which is pressed or screwed into the opening in the foot part.

* * * * *